United States Patent [19]

Hessel

[11] Patent Number: 4,707,872

[45] Date of Patent: Nov. 24, 1987

[54] RESILIENT SUPPORTING DEVICE

[76] Inventor: Lasse Hessel, Sjølundsparken 21, DK-3150 Hellebaek, Denmark

[21] Appl. No.: 755,570

[22] Filed: Jul. 16, 1985

[30] Foreign Application Priority Data

Jul. 24, 1984 [DK] Denmark ..... 3627/84

[51] Int. Cl.[4] ..... A47C 27/08

[52] U.S. Cl. ..... 5/451; 5/441; 5/468

[58] Field of Search ..... 5/451, 450, 452, 455, 5/441, 449, 422, 470, 491, 468

[56] References Cited

U.S. PATENT DOCUMENTS

| | | | |
|---|---|---|---|
| 1,353,260 | 9/1920 | Monks | 5/455 |
| 2,655,369 | 10/1953 | Musilli | 5/455 |
| 2,748,399 | 6/1956 | Rockoff | 5/455 |
| 3,548,420 | 12/1970 | Spence | 5/451 |
| 3,574,873 | 4/1971 | Weinstein | 5/451 |
| 3,810,265 | 8/1971 | McGrew | 5/450 |
| 3,879,776 | 4/1975 | Solen | 5/451 |
| 4,005,236 | 1/1977 | Graebe | 5/455 |
| 4,190,286 | 2/1980 | Bentley | 5/455 |
| 4,422,194 | 12/1983 | Virsturs et al. | 5/451 |

FOREIGN PATENT DOCUMENTS

| | | |
|---|---|---|
| 3031777 | 3/1982 | Fed. Rep. of Germany . |
| 2056270 | 12/1979 | United Kingdom . |

*Primary Examiner*—Alexander Grosz

*Attorney, Agent, or Firm*—Watson, Cole, Grindle & Watson

[57] ABSTRACT

A body supporting device comprising a plurality of liquid-filled compartments, each compartment communicating with at least one further compartment through liquid flow-inhibited flow passages, said compartments being filled with a liquid having a viscosity which is higher than that of water.

5 Claims, 5 Drawing Figures

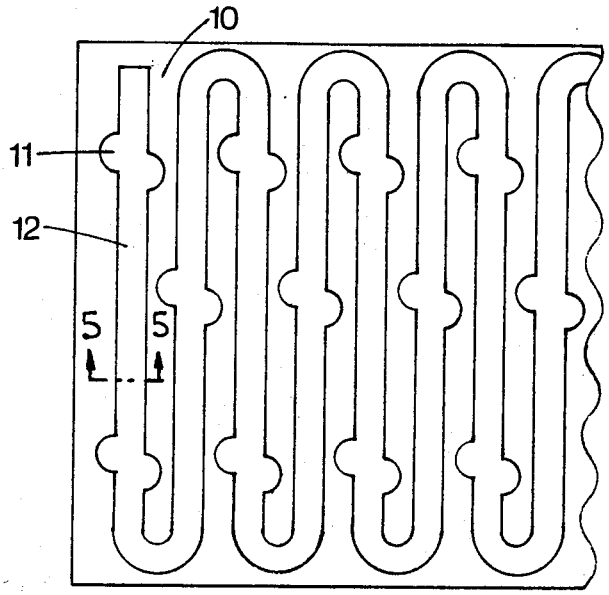
FIG.3
FIG. 5
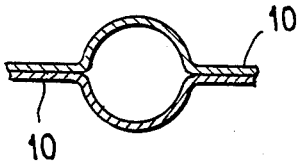
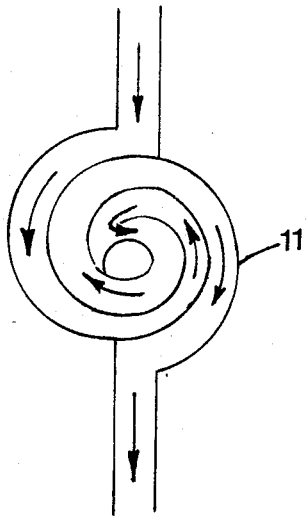
FIG.4

RESILIENT SUPPORTING DEVICE

BACKGROUND OF THE INVENTION

This invention relates to a resilient supporting device comprising a system of compartments filled with liquid and having flexible walls. More particularly, the invention relates to a resilient supporting device in the form of a mattress, cushion, pillow or the like.

A prior art liquid-filled supporting device of the above mentioned type is a waterbed mattress.

It is well known that the conventional waterbed mattresses suffer from the defect that there is a tendency for wave motions to be created in the water during use of the waterbeds. Such wave motions have a relatively long damping time and they may make the users of the waterbeds feel uncomfortable.

It has been attempted to reduce such undesired wave motions in waterbed mattresses by putting baffle plates inside the mattresses. Another solution of the same problem is disclosed in UK patent application No. 2.056.270 A which describes a waterbed mattress comprising a layer of open celled plastic foam partially submerged in the water provided within said mattress.

As disclosed in U.S. Pat. No. 3.810.265 it has also been attempted to dampen the wave motions in waterbed mattresses by adding to the water a viscosity increasing agent.

Another type of resilient supporting devices is disclosed in the published German patent application No. 30 31 777 A1 which describes i.a. a bicycle seat comprising two pads, each filled with a mixture of a flow reducing porous material (no examples of such a material are disclosed) and a viscous compressible mass consisting of air and a liquid (no examples of such liquid are disclosed).

The object of the invention is to provide a supporting device of the above mentioned type which, when loaded, produces a relatively low counter pressure during the initial loading phase and which counter pressure subsequently gradually increases to such a level that no further compression takes place.

Another object of the invention is to provide a resilient supporting device having liquid-filled compartments in which substantially no wave motion is generated during use.

SUMMARY OF THE INVENTION

These objects and other objects which will appear from the following description are achieved with the supporting device of the invention, which supporting device is characterized in that it comprises a plurality of liquid-filled compartments, each compartment communicating with at least one further compartment through a flow passage comprising liquid flow inhibiting means and that the liquid in said compartments has a viscosity which is higher than that of water.

The combined effect of the presence of the liquid flow inhibiting means between the compartments filled with liquid and the relatively high viscosity of said liquid is a substantial resistance against the flow of liquid from loaded to non-loaded or slightly loaded compartments. Thus, the supporting device will initially yield to the load. However, gradually the counter pressure increases as a result of the increasing pressure within the unloaded and slightly loaded compartments. The flow resistance produced by the flow inhibiting means and the use of a highly viscous liquid also prevent wave motions to be generated in the liquid-filled compartments.

In a preferred embodiment of the supporting device each liquid-filled compartment is connected with at least one adjacent compartment through a passage having a cross-sectional area which is substantially lower than that of the former compartment. Such a supporting device is readily manufactured, e.g. by welding together two sheets of a flexible sheet material.

The supporting device preferably comprises compartments which are dome-shaped at least on its top surface. Such a configuration of the compartments is especially useful when the device is in the form of a mattress or cushion because this configuration permits air to circulate in the free spaces between the dome-shaped compartments when a human body or part thereof is resting on said mattress or cushion.

The above mentioned embodiment presents a further advantage with respect to comfort. Thus, it is well known that a seat which exerts the same pressure on all parts of the human body in contact with the seat is less comfortable than a seat which is in contact with the human body only within separate zones. Such contact within separate zones is obtained with a supporting device comprising dome-shaped compartments.

As indicated above, the compartments may be provided by welding together two superimposed plastic sheet materials in a pattern corresponding to the desired number of compartments and interconnecting passages. In a preferred embodiment, however, the supporting device comprises compartments having walls made from a foamed elastomeric material, such as foamed neoprene rubber, because such material further increases the resiliency, i.a. by permitting a certain increase of the volume of the compartments when loaded.

Instead of using compartment walls of a foamed elastomeric-material it may be desirable to use a slab comprising a plurality of compartments, said slab being surrounded by a cover made from a foamed elastomeric material. The thickness of the walls of the foamed elastomeric material or of the cover is preferably 3–7 mm. The foamed elastomeric material may be reinforced e.g. by a Nylon fabric on one or both sides.

As mentioned above the viscosity of the liquid present in the compartments is higher than that of water and it is preferably substantially higher. The viscosity of water at 20° C. is 1.002 cp and preferred liquids are such which have viscosities of at least 10 cp at 20° C. Examples of such liquids are glycerin, ethylene glycol, animal and vegetable oils.

Also mixtures of two or more components, e.g. mixtures of oils, are suitable.

The supporting devices according to the invention have many applications. Thus, in the form of mattresses they are useful as waterbeds for ordinary use and for therapeutic use. They may also be in the form of sheets and such sheets are suitable for using a pad to be placed on top of an ordinary mattress. Such sheets are also suitable as floor-covering materials and are particularly suitable for use in places, such as shops, where people are standing on their feet for long periods. Such sheets may also be used instead of underfelts for carpets. Similarly, the sheets may be used as bed plates for machines and as a shock-absorbing material for the packing of sensitive instruments and apparatuses.

The resilient devices of the invention may also have the form of cushions and such cushions are suitable for use as chair seats including car and tractor seats. Furthermore, the supporting devices may be used in footwear, e.g. as part of shoe heels.

BRIEF DESCRIPTION OF THE DRAWING

FIG. 3 shows a top view of another embodiment of the device according to the invention, FIG. 4 shows a liquid flow inhibiting means of the device according to FIG. 3 in enlarged scale and FIG. 5 is an enlarged sectional view taken substantially along the line 5—5 of FIG. 3.

DESCRIPTION OF THE PREFERRED EMBODIMENTS

Figure 1:
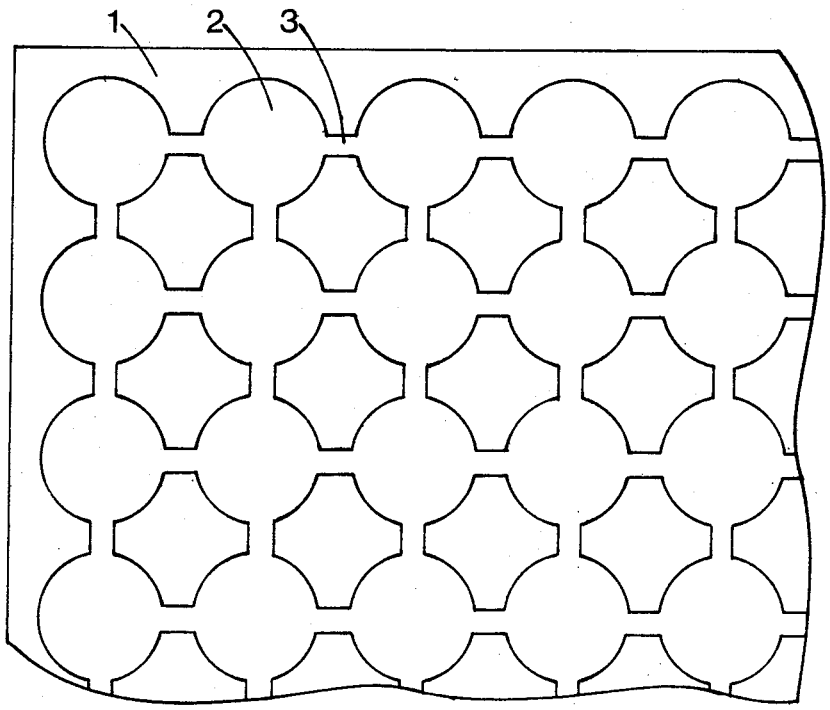
FIG. 1 shows a top view of a preferred embodiment of the device according to the invention.

FIG. 1 shows two films 1 which are welded together in such a pattern that there is provided a plurality of essentially ball-shaped compartments 2. These compartments 2 are interconnected through narrow passages 3 and both the compartments 2 and the passages 3 are filled with a viscous liquid.

Figure 2:
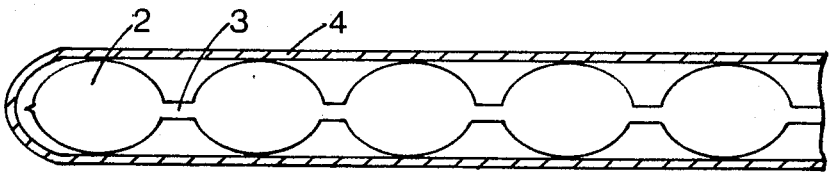
FIG. 2 shows a vertical sectional view of the device shown in FIG. 1 placed within a cover.

FIG. 2 shows a supporting device corresponding to that of FIG. 1 placed within a cover 4 made from a foamed plastics material, e.g. a foamed neoprene rubber. The supporting device shown in FIG. 3 comprises two sheets 10 which together form a continuous tube extending from one end of the device to the opposite one and being filled with a liquid. The tube is divided into compartments 12 by means of liquid flow-inhibiting means 11. These liquid flow-inhibiting means which are shown in detail in FIG. 4 comprise two interconnected oppositely directed spiral paths. Thus, when liquid is flowing from one compartment 12 to an adjacent one, the flow direction is turned about 180° when the liquid flows from one spiral path into the other one and a considerable flow resistance is generated.

I claim:

1. A resilient supporting device comprising a plurality of liquid-filled compartments having flexible walls, each of said compartments communicating with at least two other of said compartments via flow inhibiting passages, and each of said compartments being filled with a liquid having a viscosity higher than that of water, each of said passages having a cross-sectional area substantially less than that of each of said compartments and comprising two interconnected oppositely directed spiral paths such that, when liquid flows from one compartment to an adjacent compartment, flow direction of the liquid is turned about 180° when liquid flows from one spiral path into another, whereby said passages and said high viscosity liquid effect a substantial resistance against the flow of said liquid from loaded to non-loaded or slightly loaded ones of said compartments.

2. The supporting device according to claim 1, wherein said compartments have upper surfaces which are dome-shaped.

3. The supporting device according to claim 1, wherein said compartments comprise foamed elastomeric material.

4. The supporting device according to claim 1, wherein the viscosity of said liquid exceeds 10 cp at 20° C.

5. The supporting device according to claim 1, wherein said liquid is selected from the group consisting of glycerin, ethylene glycol, animal and vegetable oils and mixtures thereof.

* * * * *